United States Patent [19]

Gulla et al.

[11] 4,189,324

[45] Feb. 19, 1980

[54] STABILIZED ELECTROLESS PLATING SOLUTIONS

[76] Inventors: Michael Gulla, 24 Ivy La., Sherborn, Mass. 01770; Christy Savas, 398 Central St., Framingham, Mass. 01701

[21] Appl. No.: 911,807

[22] Filed: Jun. 2, 1978

[51] Int. Cl.[2] ..... C23C 3/02

[52] U.S. Cl. ..... 106/1.22; 106/1.27; 427/430 A; 427/438

[58] Field of Search ..... 106/1.27, 1.22, 1.25; 427/430 E, 438

[56] References Cited

U.S. PATENT DOCUMENTS

| | | | |
|---|---|---|---|
| 3,295,999 | 1/1967 | Klein et al. | 106/1.27 |
| 3,661,596 | 5/1972 | Clauss et al. | 106/1.27 |
| 3,915,716 | 10/1975 | Haack | 106/1.27 |

*Primary Examiner*—Lorenzo B. Hayes

[57] ABSTRACT

An electroless nickel plating solution is characterized by the addition of a small but effective amount of a source of gallium for improved stability and deposit properties.

12 Claims, No Drawings

STABILIZED ELECTROLESS PLATING SOLUTIONS

BACKGROUND OF THE INVENTION

1. Field of the Invention

This invention relates to an electroless nickel plating solution having improved stability and plating properties characterized by the addition of a stabilizer comprisig a source of gallium.

2. Description of the Prior Art

Electroless metal deposition refers to the chemical plating of a metal over an active or activated surface by chemical reduction in the absence of an external electric source. Processes and compositions useful therefor are known, are in substantial commercial use and are described in numerous publications. Electroless nickel formulations are disclosed in U.S. Pat. Nos. 3,661,596; 3,738,849; 3,915,713; and 4,038,085, all included herein by reference.

Known electroless nickel plating solutions generally comprise four major ingredients dissolved in water. They are (1) a source of plating metal ions, (2) a reducing agent such as hypophosphite or boron compound such as borohydride or an amine borane, (3) a pH adjuster to provide required solution pH and, preferably, (4) a complexing agent for the plating metal ions sufficient to prevent their precipitation from solution.

In addition to the above major components, it is known that other additives are needed for a practically useful formulation, for example, to stabilize the solution and improve deposit properties. With regard to stabilization, it is known that certain additives added to an eletroless solution in properly controlled trace quantities act as stabilizers and retard the rate of bath decomposition. Generally, these additives, or stabilizers as they are referred to in the art, are catalytic poisons when used in excess of minute quantities. The concentration of the stabilizer in solution is usually critical. Trace quantities, typically in the range of a few parts per million, provide stability. An excess of stabilizer may partially or totally stop deposition of the electroless nickel. Known stabilizers are disclosed in the above referenced patents and others are disclosed in U.S. Pat. Nos. 3,717,482 and 3,719,508, also incorporated herein by reference.

STATEMENT OF THE INVENTION

The present invention is based upon the discovery that the addition of a small but effective amount of a source of gallium to an electroless nickel solution improves stability without substantially retarding the rate of deposition within a relatively broad concentration range, and, in some, but not all plating solutions, appear to improve deposit properties. Accordingly, the present invention provides an electroless deposition solution comprising (1) a source of nickel ions, (2) a reducing agent such as hypophosphite, (3) a pH adjuster, (4) preferably, a complexing agent for the plating metal ions sufficient to prevent their precipitation in solution and (5) a stabilizer for the solution which may be a source of gallium alone or in combination with a secondary stabilizer.

DESCRIPTION OF THE PREFERRED EMBODIMENTS

As noted above, gallium improves bath stability. The term "gallium" as used herein is not intended to be limited to gallium metal, but rather is intended to mean gallium in whatever form it is present in the plating solution including gallium ions, complex gallium ions and the like. In this respect, it is possible that in the plating solution, the addition of soluble gallium compound to solution would result in formation of a gallium containing colloid which is also within the scope of this invention. Typical examples of gallium compounds include gallium nitrate, gallium bromide, gallium chloride, gallium sulphate and complexes such as the complex of gallium and ethylene diamine tetraacetic acid. The preferred gallium compound is gallium trichloride.

Gallium is not a catalytic poison in relatively large concentrations in comparison to other stabilizers such as sulfur and cyanide compounds. Therefore, the gallium concentration in solution is not as critical as with other stabilizers. Frequently, the required amount of gallium is much dependent upon the particular solution to which the gallium is added. Therefore, some routine experimentation may be required to optimize the concentration of the gallium. In general, for purposes of setting forth guidelines, a preferred range for gallium expressed as the metal comprises from about 5 to 500 parts per million parts of solution and a more preferred range comprises form 50 to 350 parts per million.

In some plating solutions, the gallium appears to improve deposit properties in that the deposit obtained from solution is brighter and smoother. Though the reason for improved appearance is not fully understood, and it is difficult to predict which baths will provide improved deposits as a consequence of gallium addition, it is believed that the substitution of gallium as a stabilizer for sulfur in a solution normally containing a sulfur stabilizer might be responsible for the improvement. If so, the improvement might comprise the absence of sulfur rather than the presence of gallium. In this respect, see U.S. Pat. No. 3,832,168.

With the exception of the gallium compound, the electroless solution conforms to the prior art as represented above. Since such solutions are known, their compositions need not be discussed in further detail.

The solutions of the invention are used to deposit nickel in conventional manner. The surface of a part to be plated should be free of grease and contaminating material. Next, the surface to receive the metal deposit, if not catalytic, is sensitized to render it catalytic to the reception of the electroless metal as by the well-known treatment of contact with a colloid of palladium having a protective stannic acid colloid. Thereafter, following known rinsing steps, the part is immersed in the plating solution at a temperature dependent upon the solution used for a time sufficient to provide a deposit of desired thickness.

The invention will be better understood by reference to the examples where the time to initiate deposition and solution stability for each of the test solutions was determined. The time to initiate deposition was determined by immersing a mildly activated steel plaque measuring $1\frac{1}{2}$ inches by 4 inches into 250 ml of the test solution at a temperature of 190°–195° F. and watching for the initiation of deposition as evidenced by gassing from the surface of the steel part.

Stability is measured by the time it takes a test solution to spontaneously decompose (trigger) when plating catalyzed cloth. Catalyzed cloth is prepared by immersing cotton cloth in a 5–10% solution of ammonium hydroxide for several minutes, rinsing in water and immersing in a 5–10% solution of acetic acid for several minutes and rinsing, quickly dipping in the aforesaid ammonium hydroxide solution and thoroughly rinsing the cloth and removing excess liquid, dipping in a 3–5% solution of hydrochloric acid for several minutes, immersing in a 6% solution of Catalyst 44 of Shipley Company (a tin palladium colloidal catalyst) at room temperature for 1 minute, rinsing three times in water and immersing in Accelerator 19 of Shipley Company for about 3 minutes and drying. For each of the examples, a 250 ml solution was tested. The catalyzed cloth used measured 4 square inches.

EXAMPLES 1–11

| | |
|---|---|
| Nickel chloride hexahydrate (gm) | 20 |
| Sodium hypophosphite monohydrate (gm) | 15 |
| Hydroxyacetic acid (70%) ml | 35 |
| Ammonium hydroxide | to pH 5.3 |
| Water | to 1 liter |

Catalyzed cloth was plated with the aliquot of the above formulation at a temperature of 190°–200° F. with gallium added as a 1% solution of chloride salt in amounts and with results as set forth in the following table:

| Example No. | Amount (ppm as gallium chloride) | Time (min) |
|---|---|---|
| 1 | 0 | 2 |
| 2 | 10 | 3 |
| 3 | 100 | 6 |
| 4 | 120 | 6 |
| 5 | 140 | 10 |
| 6 | 160 | >60 |
| 7 | 200 | >60 |
| 8 | 400 | >60 |
| 9 | 600 | >60 |
| 10 | 800 | >60 |
| 11 | 1,000 | >60 |

The above results show an improvement with gallium. It should be noted that the results set forth are approximate as they are based upon visual observation. In addition, for the formulation of these examples, it was observed that about 160 ppm of gallium chloride (about 65 ppm as gallium metal) were required for prolonged plating, about 400 ppm (160 ppm as metal) were required to prevent plate-out on the sides of the beaker and about 800 ppm (about 320 ppm as metal) were required for preventing dusting on the bottom of the beaker.

EXAMPLE 12

Using the baths of Examples 1 to 11 for the determination of take-off time over mildly activated steel, it was found that at a gallium chloride content of 800 ppm (320 ppm as metal), plating would not start, showing that gallium does inhibit plating over a typical catalytic surface.

A preferred stabilizer for purposes herein comprises gallium prepared by dissolving metallic gallium in boiling hydrochloric acid for 24 hours.

We claim:

1. In an aqueous electroless plating solution comprising a source of nickel ions, a pH adjuster and a reducing agent for said ions; the improvement comprising the addition of gallium to the solution in an amount of at least 1 part per million parts of solution.

2. In an acid aqueous electroless nickel plating solution including a source of nickel ions, acid as a pH adjuster and hypophosphite as a reducing agent for said nickel ions, the improvement comprising the addition of gallium to the solution in an amount of at least 1 part per million parts of solution.

3. The solution of claim 2 containing a complexing agent in a concentration sufficient to render the nickel ions soluble in solution.

4. The solution of claim 3 where the gallium in solution is derived from a gallium salt having an anionic portion noninterfering with said electroless plating solution.

5. The solution of claim 3 where the gallium is in an amount varying from 5 to 500 parts per million parts of solution.

6. The solution of claim 5 where the amount varies from 50 to 350 parts per million parts.

7. The solution of claim 3 containing an additional stabilizing agent.

8. A method for increasing the stability of an electroless nickel plating solution comprising a source of mickel ions, a pH adjuster and a reducing agent for said ions, said method comprising the step of adding a source of gallium to said solution in a concentration of at least one part per million parts of solution.

9. The method of claim 8 where the solution contains a complexing agent in an amount sufficient to solubilize said nickel.

10. The method of claim 9 where the solution contains an additional stabilizer.

11. The method of claim 9 where the gallium is added to solution in an amount of from 5 to 500 parts per million parts of solution.

12. The method of claim 11 where the concentration varies between 50 and 250 parts per million.

* * * * *